US005915848A

United States Patent [19]

Deason

[11] Patent Number: 5,915,848

[45] Date of Patent: Jun. 29, 1999

[54] METHOD AND APPARATUS FOR SUPPORTING SWIMMING POOL LIGHTING STRIP

[76] Inventor: Ted E. Deason, 1110 E. Silvertree, Tucson, Ariz. 85718

[21] Appl. No.: 08/810,242

[22] Filed: Mar. 3, 1997

[51] Int. Cl.[6] ..... E04H 4/00

[52] U.S. Cl. ..... 4/496; 52/28; 4/504

[58] Field of Search ..... 4/496, 503, 504, 4/506; 52/28; 24/545, 563, 293; 362/32, 396, 288

[56] References Cited

U.S. PATENT DOCUMENTS

| | | | |
|---|---|---|---|
| 318,204 | 5/1885 | Proudfit | 24/563 |
| 451,925 | 5/1891 | Fritz | 24/545 |
| 747,682 | 12/1903 | Brodin | 24/563 |
| 2,347,234 | 4/1944 | Allen | 24/545 |
| 2,789,782 | 4/1957 | Huth | 24/563 |
| 2,916,113 | 12/1959 | Lee | 24/563 |
| 3,193,229 | 7/1965 | Stock | 362/396 |
| 4,378,120 | 3/1983 | Laine | 24/545 |
| 4,901,492 | 2/1990 | Coates | 4/506 |
| 4,980,934 | 1/1991 | Dahowski et al. | 4/496 |
| 5,170,517 | 12/1992 | Stegmeier | 4/503 |
| 5,388,284 | 2/1995 | Garnett | 24/563 |
| 5,388,314 | 2/1995 | Vella | 4/503 |
| 5,680,730 | 10/1997 | Epple | 4/496 |

*Primary Examiner*—Charles R. Eloshway
*Attorney, Agent, or Firm*—Tod R. Nissle, P.C.

[57] ABSTRACT

A clip for mounting a light strip along the side of a pool. The clip is mounted on an arm of a cove strip. The clip is shaped to support the light strip.

10 Claims, 3 Drawing Sheets

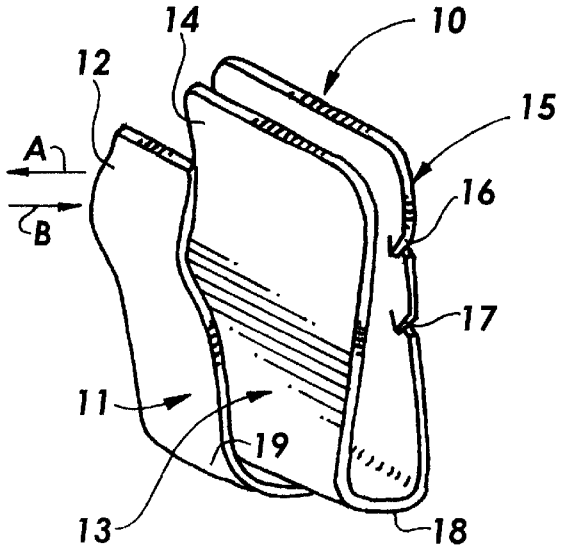
FIG. 1
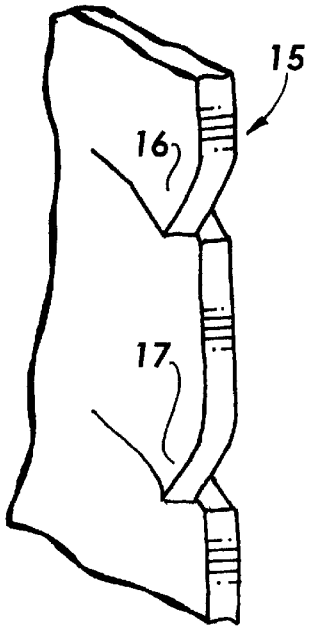
FIG. 2
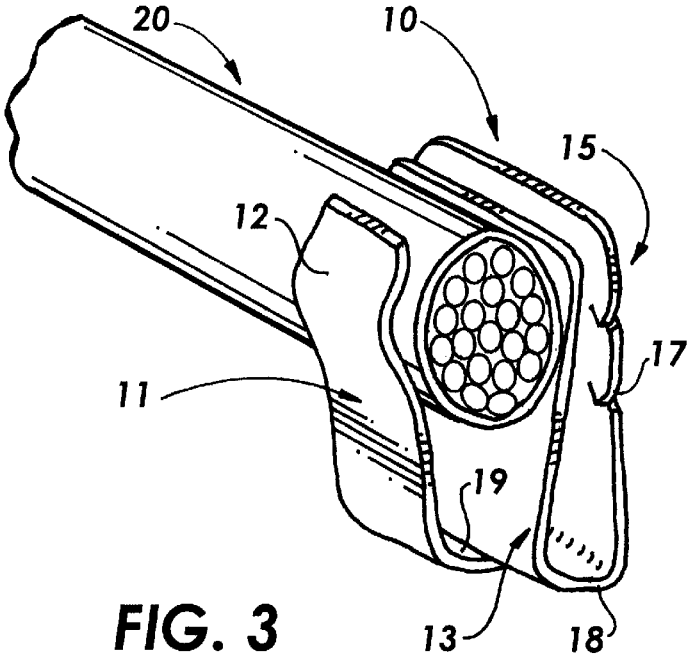
FIG. 3
FIG. 4
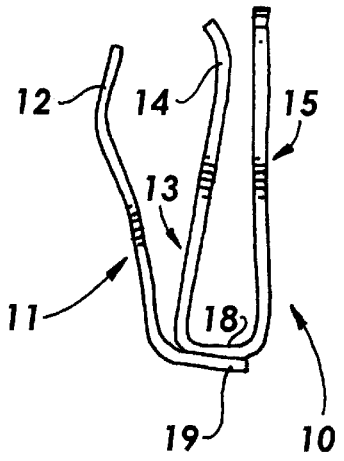

METHOD AND APPARATUS FOR SUPPORTING SWIMMING POOL LIGHTING STRIP

This invention relates to clips.

More particularly, the invention relates to clips for holding a light strip in place in a swimming pool.

Many swimming pools include a continuous coping strip which is utilized in making the deck and associated coping of a swimming pool. Although the shape of the coping strip can vary, many conventional coping strips have a T-shaped cross section and include four arms. Each arm is perpendicular to two of the remaining arms and is parallel to and co-linear with the third one of the remaining arms. Such a conventional coping strip is indicated by reference character 21 in FIG. 5 herein. Other conventional coping strips are formed to carry to support a strip of fiber optic cable immediately beneath the coping which extends around the top of a swimming pool. For example, U.S. Pat. No. 5,170,517 to Stegmeier discloses an elongate U-shaped polymeric coping strip or channel support (reference character 10 in Stegmeier) which extends beneath the overhang of the decking (reference character 54 in Stegmeier) and which is positioned at the juncture between the decking (reference character 54 in Stegmeier) and the tile on the pool wall (reference characters 44 and 14 in Stegmeier). A fiber optic strip (reference character 12 in Stegmeier) is snapped into the U-shaped channel support. The Stegmeier U-shaped channel support includes an outwardly extending arm (reference character 38 in Stegmeier) which anchors the channel support in the concrete decking of a pool.

There are disadvantages associated with the swimming pool coping strips formed to carry fiber optic cables. First, such strips cost more to extrude and produce than conventional coping strips. Second, coping strips formed to support a fiber optic cable typically are formed to support a fiber optic cable having a specific diameter or size.

Accordingly, it would be highly desirable to provide an improved method and apparatus which would enable different sized strips of fiber optic cable to be inexpensively mounted beneath the coping or other area of a swimming pool.

Therefore, it is a principal object of the invention to provide an improved method and apparatus for mounting fiber optic cable.

A further object of the invention is to provide mounting apparatus which can be utilized to mount fiber optic cables of differing size on a swimming pool.

Another object of the invention is to provide light cable mounting apparatus which can be utilized with swimming pool coping strips of differing shape and dimension.

These and other, further and more specific objects and advantages of the invention will be apparent to those skilled in the art when taken in conjunction with the following detailed description thereof and with the drawings in which:

FIG. 1 is a perspective view illustrating a clip constructed in accordance with the principles of the invention;

FIG. 2 is an enlarged view of a portion of the clip of FIG. 1 illustrating teeth integrally formed on the clip;

FIG. 3 is a perspective view of the clip of FIG. 1 with a light cable or strip mounted in the clip;

FIG. 4 is a side view further illustrating the clip of FIG. 1;

Figure 5:
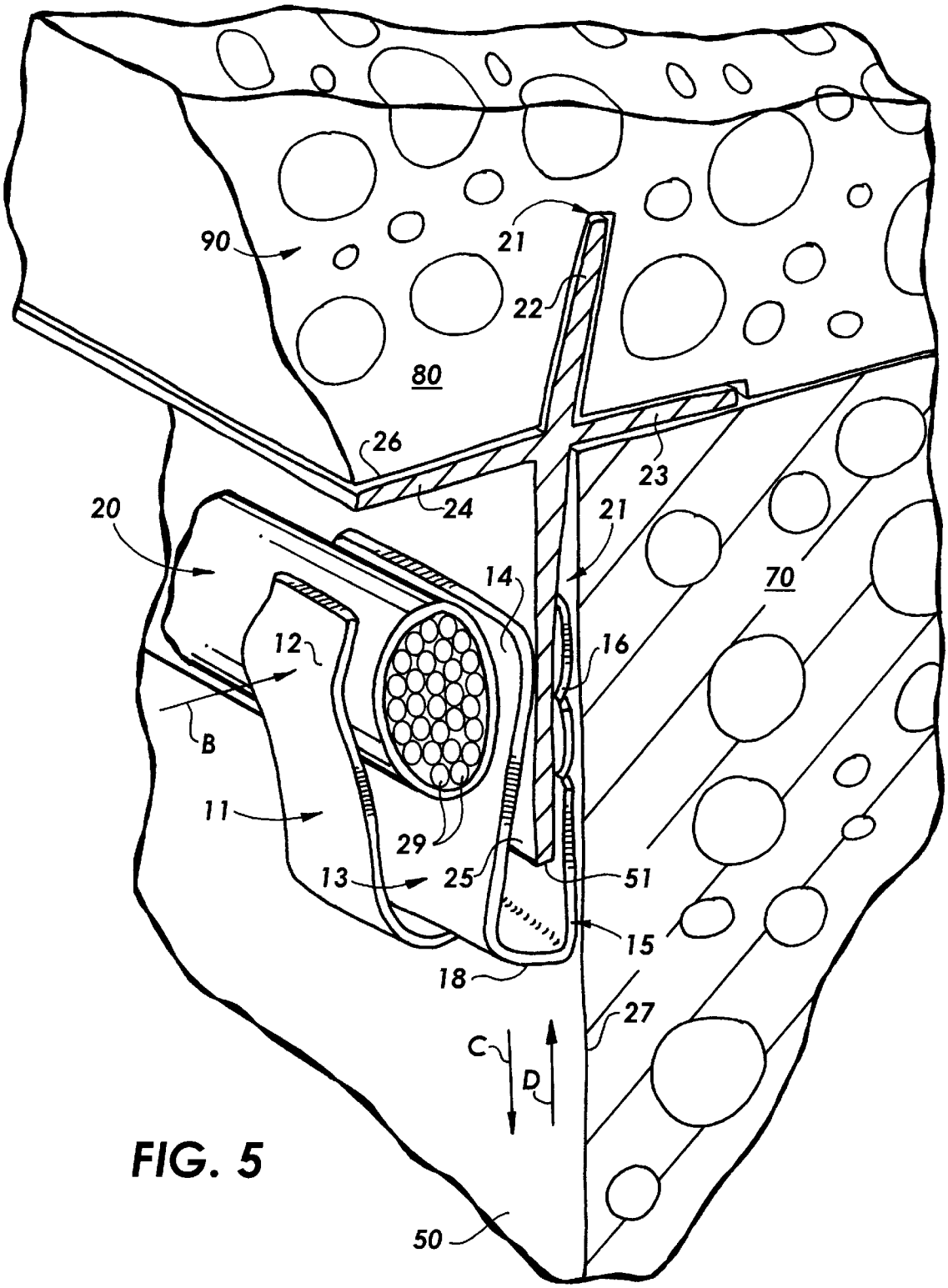
FIG. 5 is a perspective view illustrating the clip of FIG. 1 to 3 utilized to support a fiber optic cable adjacent the side wall and beneath the coping of a swimming pool.

Briefly, in accordance with my invention, I provide a clip for mounting a light strip on a swimming pool. The swimming pool includes a side including an upper portion; a pool deck coterminating with the upper portion of the side; and, a cove strip including an arm extending over a portion of the swimming pool. The clip includes a first leg shaped and dimensioned to be inserted intermediate the arm and the portion of the swimming pool; and, a second leg shaped and dimensioned to hold the light strip intermediate the second leg and the portion of the swimming pool.

In another embodiment of the invention, I provide an improved method for mounting a light strip on a swimming pool. The swimming pool includes a side including an upper portion; a pool deck coterminating with the upper portion of the side; and, a cove strip including an arm extending over a portion of the swimming pool. The improved method includes the step of providing a clip. The clip includes a first leg shaped and dimensioned to be inserted intermediate the arm and the portion of the swimming pool; and, a second leg shaped and dimensioned to hold the light strip intermediate the second leg and the portion of the swimming pool. The method also includes the steps of inserting the first leg intermediate the arm and the portion of the swimming pool; and, inserting the light strip intermediate the second arm and the portion of the swimming pool.

In another embodiment of the invention, I provide an improved clip for mounting an object on a swimming pool. The swimming pool includes a side including an upper portion; a pool deck coterminating with the upper portion of the side; and a cove strip including an arm extending over a portion of the swimming pool. The clip includes a first leg shaped and dimensioned to be inserted intermediate the arm and the portion of the swimming pool; and, a second leg shaped and dimensioned to hold the object intermediate the second leg and the portion of the swimming pool.

Turning now to the drawings which illustrate the presently preferred embodiments of the invention for the purpose of illustrating the practice thereof and not by way of limitation of the scope of the invention, and in which like reference characters refer to corresponding elements throughout the several views, spring clip 10 includes legs 11, 13, and 15. Legs 13 and 15 depend from base 18. Leg 11 depends from base 19. Base 19 is welded or otherwise attached to or integrally formed with base 18. Leg 11 includes arcuate portion 12 shaped to conform to and extend over a cylindrically shaped cable or other object positioned intermediate legs 11 and 13. Leg 13 includes arcuate portion 14 shaped to provide linear point contact with a panel shaped member inserted intermediate legs 13 and 15. Portions 12 and 14 can be flat, arcuate, include teeth or serrations, not include teeth or serrations, or can take on any desired shape and dimension. When resilient leg 11 is deflected outwardly away from leg 15 in the direction of arrow A, leg 11 produces a displacement force indicated by arrow B which elastically attempts to return leg 11 to the normal "at rest" position illustrated in FIG. 1. Similarly, when resilient leg 13 is deflected outwardly away from leg 15 in the direction of arrow A, leg 11 produces a displacement force indicated by arrow B which elastically attempts to return leg 13 to its normal "at rest" position illustrated in FIG. 1. Accordingly, elastic legs 11 and 13 each function to produce a compressive force on an object which is inserted intermediate the leg (11 or 13 as the case may be) and leg 15.

Legs 13 and 15 and base 18 are shaped and dimensioned to receive a portion of the arm 25 of a coping strip 21 (FIG.

4) or to receive any other desired object. Legs 11 and 13 and base 19 are shaped and dimensioned to receive a strip 20 (FIG. 4) of fiber optic lighting cable comprising one or more fiber optic strands 29 or to receive any other desired object.

Barbs 16 and 17 engage arm 25 or another object inserted between legs 13 and 15 and help prevent clip 10 from being pulled off arm 25 in the direction of arrow C.

Clip 10 is utilized in conjunction with a swimming pool including a pool wall 70 with a vertically oriented surface 50 which contacts water in the pool. The swimming pool also includes a horizontally oriented deck 80 which includes a coping 90. Coping 90 ordinarily overhangs surface 50. T-shaped semi-rigid coping strip 21 extends along the juncture of wall 70 and deck 80. Coping strip 21 includes arms 22, 23, 24, 25. Arm 24 extends along and typically contacts lower surface 26 of coping 90. Surface 26 extends outwardly away from surface 50. Arm 25 extends along and typically contacts surface 50. Strip 21 can be fabricated from any desired material and have any desired shape and dimension, but ordinarily strip 21 includes an arm 25 which extends over surface 50 and another arm 24 which extends over surface 26. Arms 24 and 25 typically contact surfaces 26 and 50, respectively, but need not contact said surfaces. Arms 24 and 25 can also, if desired, extend away from surface 26 and/or 50. Strip 21 is typically fabricated from PVC or another semi-rigid plastic which permits an arm 24, 25 to be bent at least a short distance away from a surface 26, 50.

FIG. 4 is a side view of clip 10, except that barbs 16 and 17 have been omitted for the sake of clarity. FIG. 4 illustrates the fixation of base 19 to base 18. Base 19 is welded, glued, fastened or otherwise fixedly attached to base 18. Base 19 can be integrally formed with base 18.

In use of clip 10, clip 10 is slid along surface 50 in the direction of arrow D in FIG. 5 such that arm 25 is, if necessary, bent a short distance away from surface 50 and is forced between legs 13 and 15 to the position shown in FIG. 5. While arm 25 can be forced or slid down between legs 13 and 15 to a position where lower edge 51 seats on and contacts base 18, arm 25 presently typically only extends between legs 13 and 15 part way to base 18, so that edge 51 is spaced apart from base 18. Barbs 16 and 17 engage arm 25, help prevent clip 10 from sliding off arm 25 in the direction of arrow C, and help anchor clip 10 in the position shown in FIG. 5. Adhesive, screws, or any other means can be utilized to secure removably or fixedly clip 10 in position on arm 25. As would be appreciated by those of skill in the art, clip 10 can also, if desired, be slid over arm 24 such that arm 24 is bent a short distance away from surface 26, such that leg 15 is intermediate arm 24 and surface 26, and such that arm 24 is intermediate legs 13 and 15.

After clip 10 is mounted on arm 25 in the orientation shown in FIG. 5, fiber optic cable 20 is forced between legs 11 and 13 to the position illustrated in FIG. 5. When cable 20 is in the position shown in FIG. 5, leg 11 is elastically displaced in a direction opposite that of the direction indicated by arrow B, causing leg 11 to generate a compressive force acting on cable 20 in the direction of arrow B and compressing cable 20 against leg 13. Similarly, when arm 25 is in the position shown in FIG. 5, arm 25 elastically displaces leg 13 in a direction opposite that of the direction indicated by arrow B, causing leg 13 to generate a compressive force acting on arm 25 in the direction of arrow B.

Figure 6:
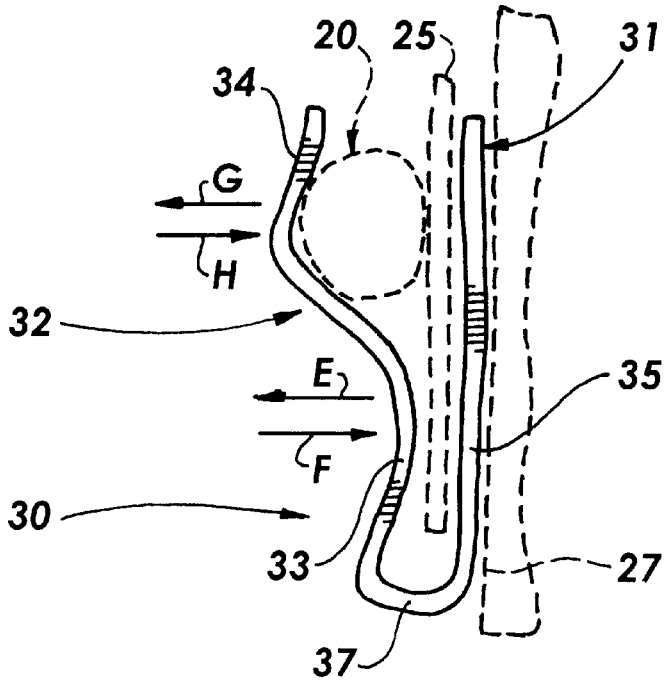
FIG. 6 is a side view illustrating another embodiment of the clip of the invention.

Another embodiment of the invention is illustrated in FIG. 6 and includes a clip 30. Clip 30 is in many respects similar to clip 10. Clip 30 includes a pair of resilient legs 31 and 32 depending from a base 37. Leg 31 is, like leg 15, substantially flat (although the shape and dimension of leg 31 can, like leg 15, vary as desired). Leg 32 includes arcuate portion 33 shaped and dimensioned such that the lower portion of leg 32 is resiliently displaced outwardly away from leg 31 in the direction of arrow E when arm 25 slides in between legs 31 and 32. When the lower portion of leg 32 is resiliently displaced away from leg 31, the lower portion of leg 32 generates a compressive force acting on arm 25 in the direction of arrow F. Alternatively, legs 31 and 32 and base 37 (or legs 13 and 15 and base 18) can be formed such that they are substantially rigid, such that legs 31 and 32 are not readily forced apart, and such that arm 25 must be frictionally force fit between legs 31 and 32. Leg 32 also includes an arcuate section 34 shaped and dimensioned such that the upper portion of leg 32 is resiliently displaced outwardly away from leg 31 in the direction of arrow G when cable 20 is forced between legs 32 and 31. When the upper portion of leg 32 is resiliently displaced in the direction of arrow G from leg 31, the upper portion of leg 32 generates a compressive force acting on cable 20 in the direction of arrow H. In FIG. 6, clip 30 is mounted in its normal operative position on arm 25 in the same manner that clip 10 is mounted on arm 25 in FIG. 5.

Figure 7:
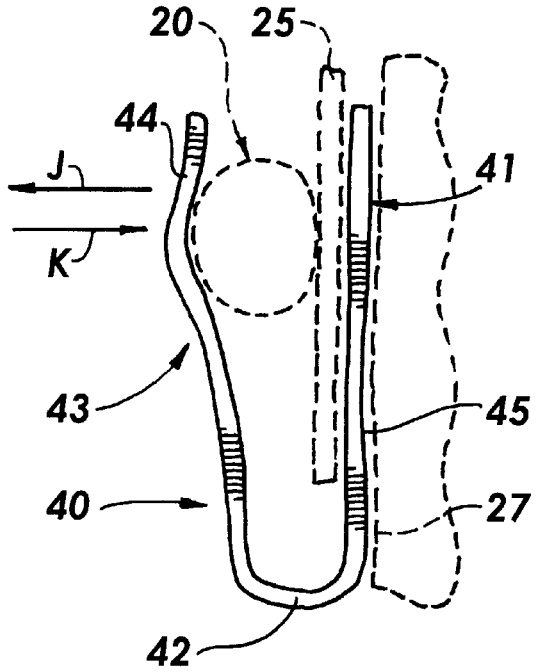
FIG. 7 is a side view illustrating still another embodiment of the clip of the invention.

A further embodiment of the invention is illustrated in FIG. 7 and includes a clip 40. Clip 40 is in many respects similar to clip 10. Clip 40 includes a pair of resilient legs 41 and 43 depending from a base 42. Leg 41 is, like leg 15, substantially flat (although the shape and dimension of leg 41 can, like leg 15, vary as desired). Leg 43 includes an arcuate section 44 shaped and dimensioned such that the upper portion of leg 43 is resiliently displaced outwardly away from leg 41 in the direction of arrow J when cable 20 is forced between legs 41 and 43. When the upper portion of leg 43 is resiliently displaced in the direction of arrow J from leg 41, the upper portion of leg 43 is resiliently displaced in the direction of arrow J from leg 41, the upper portion of leg 43 generates a compressive force acting on cable 20 in the direction of arrow K. In FIG. 7, clip 40 is mounted in its normal operative position on arm 25 in the same manner that clip 10 is mounted on arm 25 in FIG. 5.

FIG. 2 is an enlarged view of the barbs on leg 15. FIG. 3 is a perspective view of cable 20 mounted in clip 10.

The shape and dimension of the legs 11, 13, 15, 31, 32, 41, and/or 43 comprising a clip 10, 30 or 40 can vary as desired. Although it is presently preferred that such legs and clips be elastically displaceable, in some circumstances it may be desirable to make the legs and clip substantially rigid and stiff.

The clip of the invention can be utilized on swimming pools in which the deck does not extend out over the wall of the pool, but is instead flush with or recessed back away from the wall of the pool.

Having described my invention in such terms as to enable those skilled in the art to understand and use it, and having described the presently preferred embodiments thereof,

I claim:

1. In combination a swimming pool including (a) a side including an inner water-contacting face having an upper portion;

(b) a pool deck coterminating with said upper portion of said side;

(c) a cove strip including an arm extending over said upper portion of said side of said swimming pool;

(d) a light strip;

(e) at least one clip supporting said light strip and including (i) a first leg inserted intermediate contacting both said arm and said upper portion of said swimming pool, and (ii) a second spring leg holding said light strip intermediate said second leg and said upper portion of said swimming pool and acting on said light strip to compress said cove strip arm between said first leg and said light strip.

2. The combination of claim 1 wherein said first leg includes at least one barb intermediate said arm and said upper portion and engaging said arm.

3. The combination of claim 1 wherein a portion of said cove strip extends into to said pool deck.

4. The combination of claim 1 wherein said first leg displaces said arm away from said upper portion of said side of said swimming pool.

5. A method for mounting a light strip on a swimming pool including a side including an inner water-contacting face having an upper portion, a pool deck coterminating with said upper portion of said side, and a cove strip including an arm adjacent and extending over said upper portion of swimming pool, said arm including a distal end displaceable away from said upper portion of said side of said swimming pool, said method including the steps of (a) obtaining a clip including (i) a first leg shaped and dimensioned to be inserted intermediate said distal end of said arm and said upper portion of said swimming pool such that said leg contacts both said arm and said upper portion and displaces said distal end away from said upper portion of said side of said swimming pool, and, (ii) a second leg shaped and dimensioned to hold said light strip intermediate said second leg and said upper portion of said swimming pool;

(b) inserting said first leg intermediate said distal end of said arm and said upper portion of said wall of said swimming pool such that said leg contacts both said arm and said upper portion of said wall and displaces said distal end away from said upper portion of said side of said swimming pool; and, (c) inserting said light strip intermediate said second leg and said upper portion of said swimming pool.

6. The method of claim 5 wherein (a) in step (a) said first leg includes at least one barb which, when said first leg is inserted intermediate said arm and said upper portion, engages said arm; and (b) in step (c) said barb engages said arm when said first leg is inserted intermediate said arm and said upper portion.

7. The method of claim 5 wherein (a) in step (a) said clip includes a third spring leg shaped and dimensioned to compress said arm intermediate said first leg and said third spring leg when said first leg is inserted intermediate said arm and said upper portion of said swimming pool; and, (c) in step (c) inserting said first leg intermediate said arm and said upper portion of said swimming pool compresses said arm intermediate said third spring leg and said first leg.

8. In combination a swimming pool including (a) a side including an inner water-contacting face having an upper portion;

(b) a pool deck coterminating with said upper portion of said side;

(c) a cove strip including an arm extending over said upper portion of said swimming pool;

(d) a supportable object;

(e) at least one clip supporting said object and including (i) a first leg intermediate and contacting both said arm and said upper portion of said swimming pool, (ii) a second spring leg compressing said arm intermediate said first leg and said second leg, and, (iii) a third spring leg holding said object intermediate said second leg and said upper portion of said swimming pool and compressing said object intermediate said second and third legs.

9. The combination of claim 8 wherin said first leg includes at least one barb intermediate said upper portion and said arm and engaging said arm.

10. The combination of claim 8 wherein a portion of said cove strip extends into said pool deck.

* * * * *